US006003233A

United States Patent [19]

Vaughn et al.

[11] Patent Number: 6,003,233

[45] Date of Patent: Dec. 21, 1999

[54] REAR BOW SIGHT ASSEMBLY

[76] Inventors: Donald L. Vaughn; Sheila Vaughn, both of 151 County Rd. 105, Athens, Tenn. 37303

[21] Appl. No.: 08/969,793

[22] Filed: Nov. 13, 1997

Related U.S. Application Data

[60] Provisional application No. 60/031,227, Nov. 25, 1996.

[51] Int. Cl.[6] ..... F41G 1/467

[52] U.S. Cl. ..... 33/265

[58] Field of Search ..... 33/265, 263, 264; 124/87, 88

[56] References Cited

U.S. PATENT DOCUMENTS

| | | | |
|---|---|---|---|
| 2,559,927 | 7/1951 | Beloungy | 33/265 |
| 3,084,442 | 4/1963 | Jacobson et al. | 33/265 |
| 3,406,675 | 10/1968 | Fredrickson | 33/265 |
| 3,674,002 | 7/1972 | Diamond, Sr. | 124/87 |
| 3,922,795 | 12/1975 | Bettencourt | 33/265 |
| 4,159,575 | 7/1979 | Kalmbach | 33/265 |
| 4,215,484 | 8/1980 | Lauffenburger | 33/241 |
| 4,215,485 | 8/1980 | Mesler | 124/87 |
| 4,542,591 | 9/1985 | Montgomery | 124/87 |
| 4,570,352 | 2/1986 | Leal | 33/265 |
| 4,662,347 | 5/1987 | Carlton | 33/265 |
| 4,915,088 | 4/1990 | Powers | 124/87 |
| 4,977,678 | 12/1990 | Sears | 33/265 |
| 4,982,503 | 1/1991 | Land | 33/265 |
| 5,040,300 | 8/1991 | Sheffield | 124/87 |
| 5,040,301 | 8/1991 | Forbis | 124/87 |
| 5,048,193 | 9/1991 | Hacquet | 33/265 |
| 5,113,588 | 5/1992 | Walston | 33/264 |
| 5,454,169 | 10/1995 | Keller | 33/265 |
| 5,864,985 | 2/1999 | Giddens | 33/265 |

*Primary Examiner*—G. Bradley Bennett
*Attorney, Agent, or Firm*—Richard C. Litman

[57] ABSTRACT

A rear in-line bow sight for use in combination with a front bow sight assembly on an archery bow having a bow frame and an arrow-impelling string attached to the bow frame. The rear bow sight has an rigid construction which includes a support bracket, a sight member, and optionally, a sight guard. The support bracket is mounted to a portion of the bow, whereby an integral extension projects rearwardly of the bow frame to support a sight member intermediate the string and the bow frame. A sight head of the sight member has an aperture passing centrally therethrough to allow an archer to adjust the inclination of the bow by viewing a given sight pin of the front sight assembly through the aperture. The aperture has a diameter which is sufficiently small enough to receive the image of only one sight pin from the front sight assembly while the archer aligns the bow. Optionally, a sight guard is positioned adjacent the terminal end of the extension and rearward of the sight member to protect the sight member against misalignment caused by contact with a foreign object.

3 Claims, 4 Drawing Sheets

REAR BOW SIGHT ASSEMBLY

CROSS-REFERENCE TO RELATED APPLICATION

This application claims the benefit of U.S. Provisional Patent Application Ser. No. 60/031,227, filed Nov. 25, 1996.

BACKGROUND OF THE INVENTION

1. Field of the Invention

The present invention relates to bow sights for use with an archery bow. More particularly, the present invention relates to rear bow sights of the type that are intended to be used in conjunction with a front bow sight for aiming an archery bow.

2. Description of the Prior Art

A bow sight is a necessity for aiming a bow to fire an arrow while hunting or participating in competition shooting. Typically a front sight is used which has one or more vertically spaced, horizontal sight pins for aligning the bow with a target. Such front sight pins, however, cannot alone compensate for all of the variables of a particular shot. For example, no matter how well a front pin sight is calibrated, it cannot always compensate for the vertical drop inherent in a shot fired at the target. Typically, the archer will adjust the inclination of the bow (i.e., select a particular sight pin) to compensate for the vertical drop particular to a certain distance to the target. When selecting a particular pin sight, however, the archer may not consistently align his or her line of vision with the intended flight path of the arrow. To avoid the variability associated with unassisted adjustments made by the archer, it is well known in the prior art to utilize a rear sight for aligning the front sight upon a target located a certain distance away from the archer.

U.S. Pat. No. 5,048,193 which issued to Rodney D. Hacquet on Sep. 17, 1991, discloses a bow sight including a front sight having at least one sight pin and a rear sight having a pivotally mounted member with a V-shaped notch intended for alignment with the pin of the front sight. The pivotal rear sight member accommodates for variable distances to the desired target. Other prior art bow sights which utilize a V-shaped notch in conjunction with the rear sight are disclosed in U.S. Pat. No. 4,215,484 which issued to Robert F. Lauffenburger on Aug. 5, 1980; U.S. Pat. No. 4,915,088 which issued to Reginald G. Powers on Apr. 10, 1990; and U.S. Pat. No. 4,977,678 which issued to Benny Sears on Dec. 18, 1990.

U.S. Pat. No. 4,542,591 which issued to Glenn Montgomery on Sep. 24, 1985, discloses a bow sight assembly having a front sight element consisting of a plurality of sight pins, and an integral rear sight element consisting of a smaller sight pin encircled by a sighting ring that aids in the alignment of the front and rear pins. The sighting ring, however, is used only to highlight which of the front sighting pins with which the rear sighting pin is aligned.

U.S. Pat. No. 5,040,301 which issued to Charles L. Forbis on Aug. 20, 1991, discloses a rear bow sight that may be used in connection with a variety of front bow sights. The rear bow sight has a mounting bracket with top and bottom flanges, and a pair of parallel spaced sighting line members formed of a string loop or the like which extend between the top and bottom flanges. The mounting bracket has an open side that exposes the sighting line members to interference.

U.S. Pat. No. 4,982,503 which issued to Leo Land on Jan. 8, 1991, discloses a bow sight comprising integrally connected front and rear sights. The front sight includes a bracket with an opening having a pair of cross hairs passing therethrough and a plurality of vertically arranged sight pins adjacent to the opening. The rear sight includes a bracket with an opening having a pair of cross hairs passing therethrough, whereby aiming an arrow requires alignment of the cross hairs of the front and rear sights upon a portion of one sight pin.

U.S. Pat. No. 5,454,169 which issued to Charles R. Keller on Oct. 3, 1995, discloses front and rear bow sights designed to cooperate together for aiming a bow. The front sight includes a loop frame having a vertically aligned sight pin pivotally mounted within the loop frame. Pivoting of the pin allows the front sight to gauge proper inclination of the bow during alignment for a shot. The rear sight includes a loop frame having a single, vertically disposed cross hair used for aligning the bow according to the pivotally mounted pin sight.

U.S. Pat. No. 5,040,300 which issued to Thomas H. Sheffield on Aug. 20, 1991, discloses an archery bow sight having a single element positively biased against a range adjustment mechanism. The element includes either a single peep sight or a pair of aligned front and rear peep sights. Adjustment of the range adjustment mechanism biases the front and rear sights so that proper alignment of the bow with respect to the target is accomplished upon viewing the target through both peep sights.

U.S. Pat. No. 4,570,352 which issued to Manuel J. Leal on Feb. 18, 1986, discloses a bow sight comprising a front sight with a staircase configuration and a rear sight having an aperture provided with a pair of cross hairs. The cross hairs are intended to be aligned at various points along the staircase configuration of the front sight to accommodate for alternative distances to the desired target.

The rear in-line bow sight assembly of the present invention achieves the result of assisting an archer properly to align a bow by using a rear sight which makes apparent any significant deviation of the bow from its alignment with the target. An archer views a front sight pin through an aperture of the sight member on the rear bow sight whereby the aperture is large enough only to view a single sight pin for any given alignment of the bow. Thus, misalignment of the bow is immediately apparent to the archer.

None of the above inventions and patents, taken either singly or in combination, is seen to describe the instant invention as claimed.

SUMMARY OF THE INVENTION

The rear in-line bow sight of the present invention is intended to be used in combination with an archery bow of the type having a bow frame, an arrow-impelling string attached to the bow frame, and a front sight assembly mounted on the bow frame. The rear bow sight is particularly useful in combination with front sight assemblies having one or more sighting pins positioned forward of the bow frame.

The rear bow sight of the present invention has a rigid construction comprising a support bracket, a sight member and optionally, a sight guard. The support bracket includes a relatively wide mounting plate for securing the support bracket to a portion of the bow, and an integral extension that projects rearwardly of the mounting plate such that a terminal end of the extension lies intermediate the string and the bow frame. The sight member is rigidly connected to the extension nearer to a terminal end thereof. The sight member includes an elongated neck which has a sight head on the end thereof. The sight head is provided with an aperture passing centrally therethrough to allow an archer to adjust the inclination of the bow by viewing a given sight pin of the front sight assembly through the aperture. The sight member may either be constructed integral with the support bracket or may be adjustable relative thereto. The optional sight guard is positioned adjacent the terminal end of the extension and rearward of the sight member, which prevents foreign objects from contacting the sight member and distorting its alignment with respect to the front sight assembly.

The aperture of the sight head has a diameter which is sufficiently small to receive the image of only one sight pin from the front sight assembly while the archer aligns the bow. Thus, it is unlikely that an archer will alter alignment of the bow because any deviation is readily apparent by the improper position of the image of the sight pin within the aperture. Misalignment of the bow is also minimized by virtue of there being a sufficiently large distance between the sight member of the rear sight assembly and the sight pins of the front sight assembly, which reduces the angular displacement of the target when the sight pin appears slightly out of alignment with the aperture.

Accordingly, it is a principal object of the invention to provide a rear in-line bow sight which an archer may use in conjunction with a front bow sight to align a bow for shooting an arrow to a target.

It is another object of the invention to provide a rear in-line bow sight which may be used in conjunction with a variety of bows and front bow sights.

Yet another object of the invention is to provide a rear in-line bow sight which minimizes the likelihood of bow misalignment when compensating for vertical drop.

Still another objective of the invention is to provide a rear in-line bow sight which possesses an adjustable sight member.

Still another objective of the invention is to provide a rear in-line bow sight with an adjustable sight member which may be used in conjunction with bows having off-set risers.

It is a further object of the invention to provide a rear in-line bow sight which is simple and effective in use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
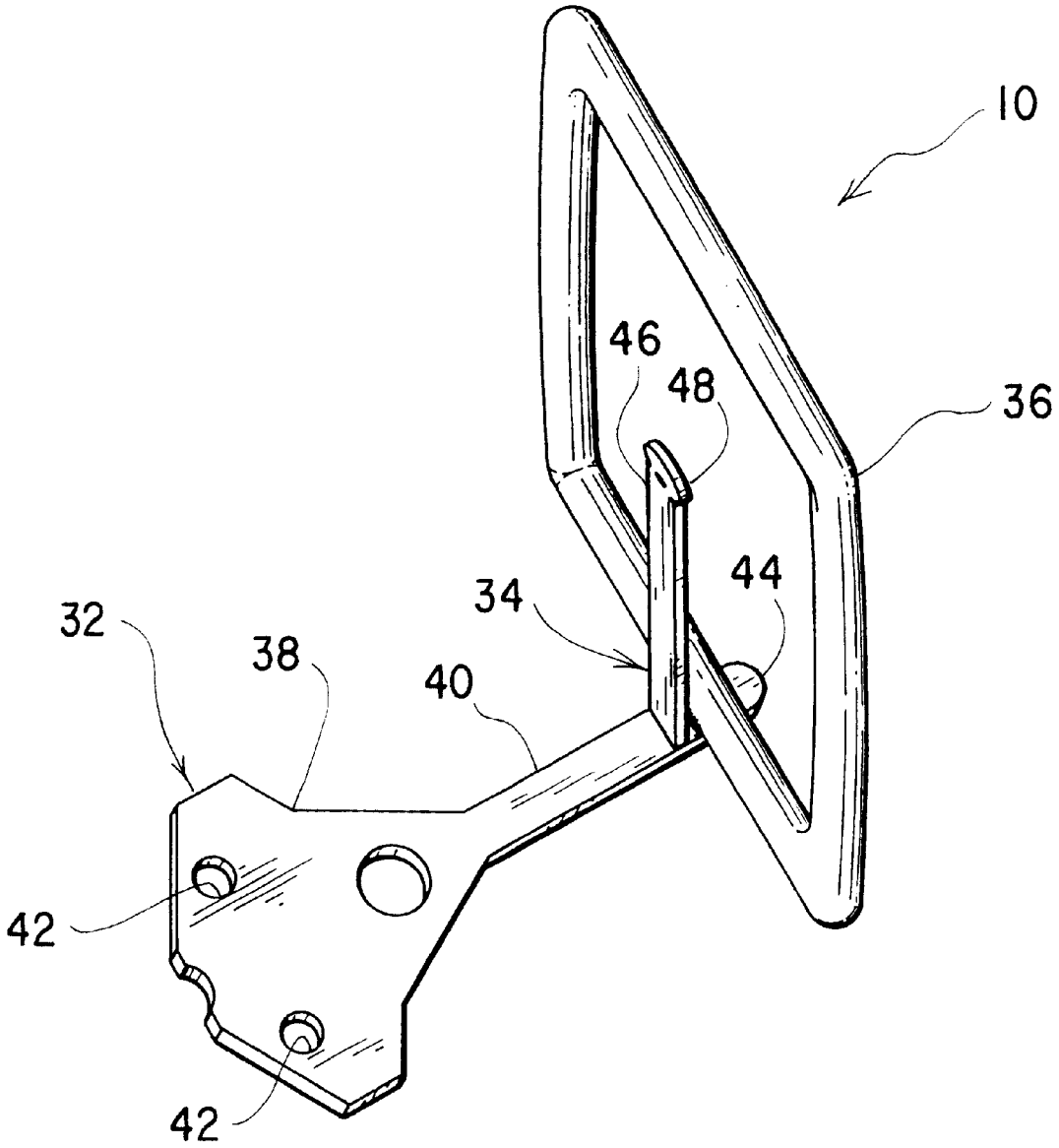
FIG. 1 is a perspective view of the rear in-line bow sight of the present invention.
Figure 2:
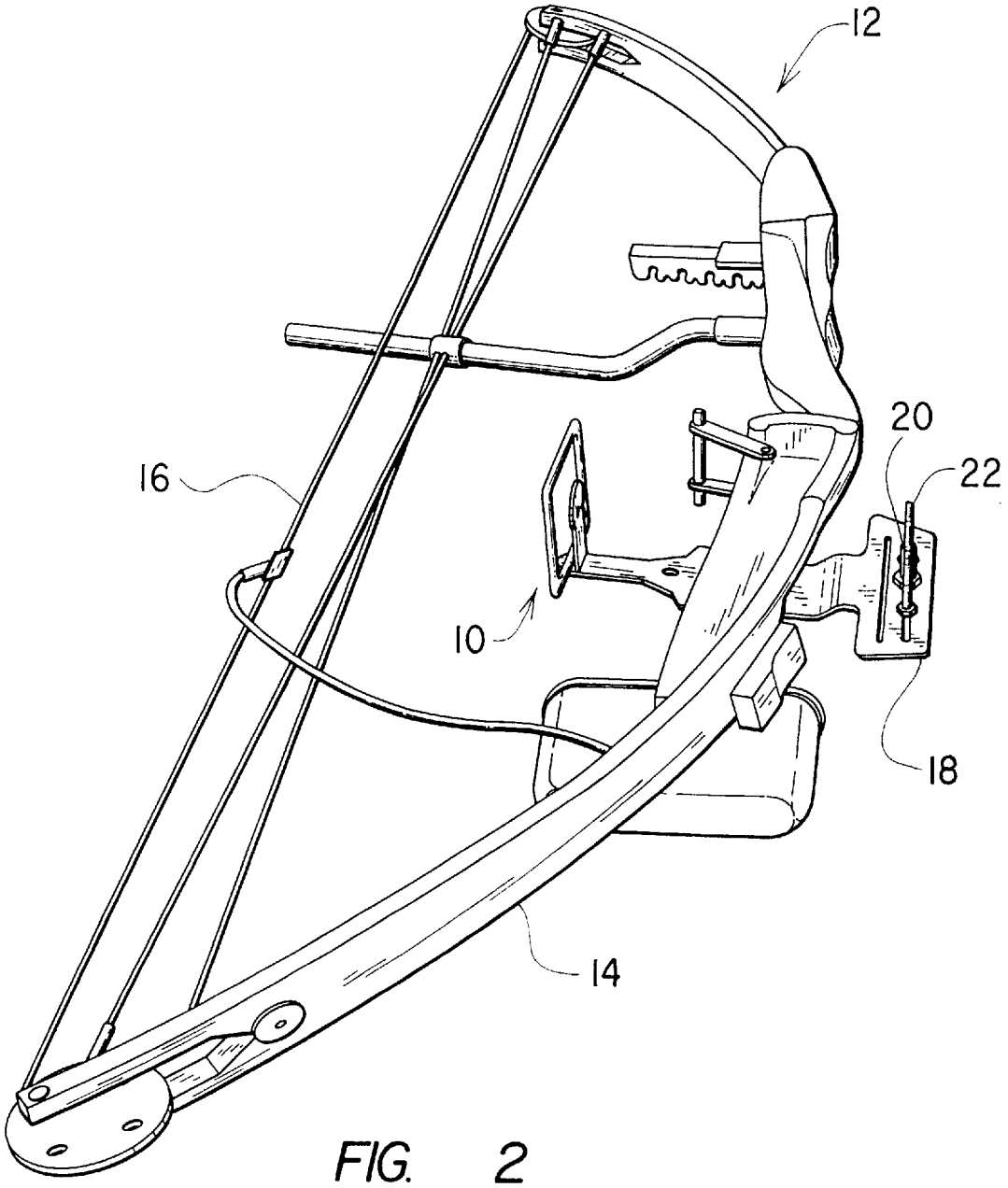
FIG. 2 is a perspective view of the rear in-line bow sight mounted upon a bow for use with a front bow sight of the type having a plurality of sighting pins.

Referring now to the figures by numerals of reference and first to FIG. 1 through FIG. 3, 10 denotes generally a rear in-line bow sight assembly of the present invention. The rear sight assembly is intended for use with an archery bow, such as a compound bow, generally denoted as 12. The rear sight assembly is disposed to be mounted upon a bow frame 14 which is equipped with an arrow-impelling string 16 to propel an arrow, and a front bow sight assembly 18 to assist an archer in aligning the bow in preparation for a shot. The compound bow 12 shown in FIG. 2 has a front sight assembly that is positioned forward of the bow frame and which is of the type having a single sighting pin 20 within a sight guard 22.

The rear sight assembly of the present invention may cooperate with any number of a variety of commercially available front sight assemblies. In particular, the rear sight assembly 10 may cooperate with front sight assemblies of the type having sighting pins such as fixed position sight pins, adjustable position sight pins, and lighted sight pins. Regardless of the particular type of front sight assembly used, such assemblies typically utilize a sight pin 20 whose horizontal position may be adjusted (i.e., during calibration) by a threaded connection between the sight pin and a pair of nuts. To assist an archer in aligning the bow to fire a shot at the target, the sight pin 20 has a sight bead 21 located at the distal end thereof. Where multiple sight pins are present, each pin represents a specific yardage distance to the target. For example, the upper most pin represents the shortest yardage to the target and the lower most pin represents the longest yardage to the target.

The rear bow sight 10 comprises a support bracket 32, a sight member 34, and a sight guard 36. Because it is foreseeable that a hunter will place substantial demands upon a bow 12 provided with a rear bow sight 10, it is preferable to form the rear bow sight from durable yet lightweight metal components which are welded rigidly together. Thus, the welding together of the above-listed components forms an integral one-piece rear bow sight which is capable of withstanding significant abuse without disrupting the alignment of the rear sight 10 with respect to the front sight 18.

The support bracket 32 includes a relatively wide mounting plate 38, which is used to mount the support bracket to a portion of the bow, and an integral elongated extension 40. To secure the support bracket 32 to the bow frame 14, the mounting plate is provided with a plurality of openings 42 passing therethrough. The openings 42 are disposed to receive a threaded screw, such as a machine screw (not shown), that may be anchored in a factory prepared fitting (not shown) provided on the bow frame 14. Typically, the rear bow sight 10 of the present invention may be secured by the same screws used to retain the front bow sight 18. After securing the support bracket 32 to the bow frame 14 by its mounting plate 38, the elongated extension 40 thereon projects rearwardly of the mounting plate. A terminal end 44 of the extension 40 lies intermediate the string 16 and the bow frame 14 so as to avoid any interference with the string.

Figure 3:
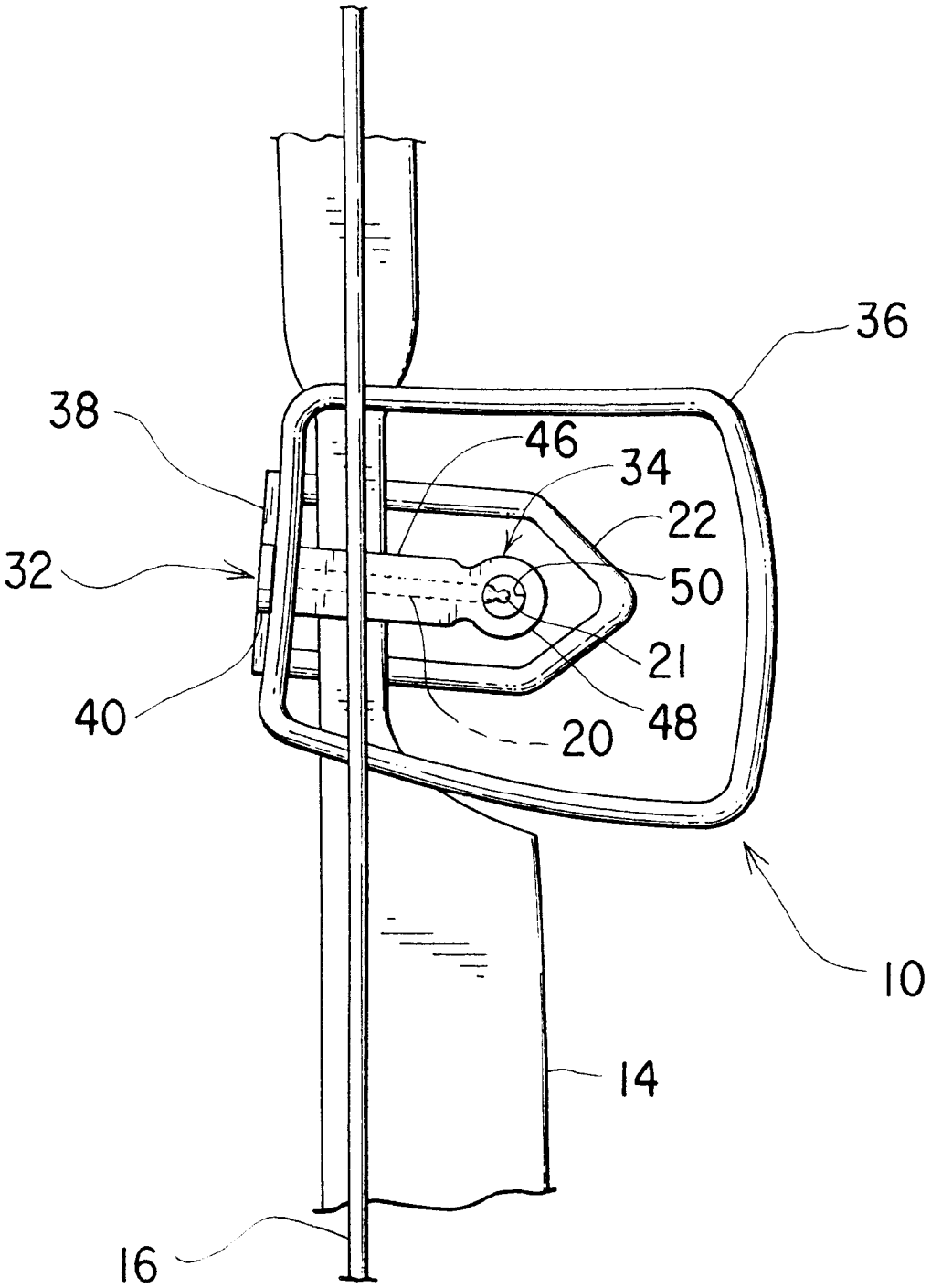
FIG. 3 is a enlarged fragmentary rear elevational view of the bow with a sighting pin of the front sight positioned within the aperture of the rear sight for alignment of the bow.

The sight member 34 is welded or otherwise rigidly connected to the elongated extension 40 of the support bracket 32. Preferably the sight member is positioned nearer to the terminal end 44 of the extension so that a sufficiently large distance exists between the sight member 34 of the rear sight assembly and the sight pins 20 of the front sight assembly. The large distance between the rear sight assembly and the front sight assembly minimizes the likelihood of bow misalignment when compensating for vertical drop. The sight member 34 includes an elongated neck 46 having a sight head 48 on the end thereof. The neck 46 is fixed at a substantially 90° angle to the extension 40 such that the sight head 48 is aligned perpendicularly to an archer's line of vision to the target. The sight head 48 has an aperture 50 passing centrally therethrough that allows an archer to adjust the inclination of the bow by viewing a given sight pin 20 of the front sight assembly 18 through the aperture. As shown in FIG. 3, an archer may select a specific sight pin (according to the distance to the target) and align the bow for a given distance to the target by viewing the desired sight pin through the aperture 50 of the rear sight assembly 10.

To further reduce the likelihood of deviation from the desired flight path of the arrow, the aperture 50 has a diameter which is sufficiently small enough to receive the image of only one sight pin from the front sight assembly while the archer aligns the bow. Thus, it is unlikely that an archer will alter alignment of the bow while any deviation is readily apparent by the improper location of the image of the bead 21 within the aperture 50. It should be noted, however, that the diameter is not so small that the bead 21 of the sight pin consumes the entire field of view through aperture 50. Instead, the aperture is sufficiently larger than the bead 21 to allow an archer to locate where on the target the bow is aligned to fire the arrow. A preferred diameter for the aperture is approximately 0.5 centimeters when the sight head is 20 centimeters away from the sight pins of the front sight assembly.

The sight guard 36 also is welded or otherwise integrally connected to the elongated extension 40 of the support bracket 32. Preferably the sight guard is positioned adjacent the terminal end 44 of the extension, whereby the sight member lies forward of the sight guard. The positioning of the sight guard 36 rearward of the sight member 34 prevents foreign objects from contacting the sight member and distorting the alignment of the sight member with respect to the front sight assembly. The sight guard 36 includes a closed loop frame that is sufficiently wide enough (i.e., several inches between the sight head and the frame of the sight guard) so as to prevent visual interference with the alignment of a shot.

In use, an archer will calibrate the front sight with the rear sight prior to using the bow for hunting or competition. To calibrate the sights, an archer will first adjust the vertical arrangement of sight pins 20 on the front sight assembly 14 so that each sight pin corresponds to a particular yardage to the target. The horizontal positioning of the front sight pins typically may be adjusted by manipulating the threaded connection between the front sight pins and the front sight bracket. Once calibrated, an archer will attempt to estimate to the yardage to the target so that a particular sight pin may be selected for use. With a sight pin selected for aiming the bow, the archer will align the bow so that the target is viewed through the aperture 50 of the sight member 34. With the target in view, the archer should adjust the inclination of the bow so that the selected sight pin is brought into the line of vision which extends through aperture 50 and to the target. With the bead 21 of the sight pin positioned centrally of the aperture 50, the bow will be aligned so that the arrow strikes the desired target (assuming the archer properly estimated the distance to the target). Any final adjustment of the bow alignment may be conducted following full draw of the string.

Although not shown, it should be apparent that the sight member also may be adjustably mounted to the support bracket for allowing a user to set the sight member to a position which is well suited and comfortable for a particular archer. Since each archer holds the bow at a slightly different position when the bow is at full draw, an adjustable connection between the sight member and the support bracket is desirable. However, the adjustable connection should be sufficiently rigid and durable to withstand any normal abuse of the bow while hunting.

Figure 4:
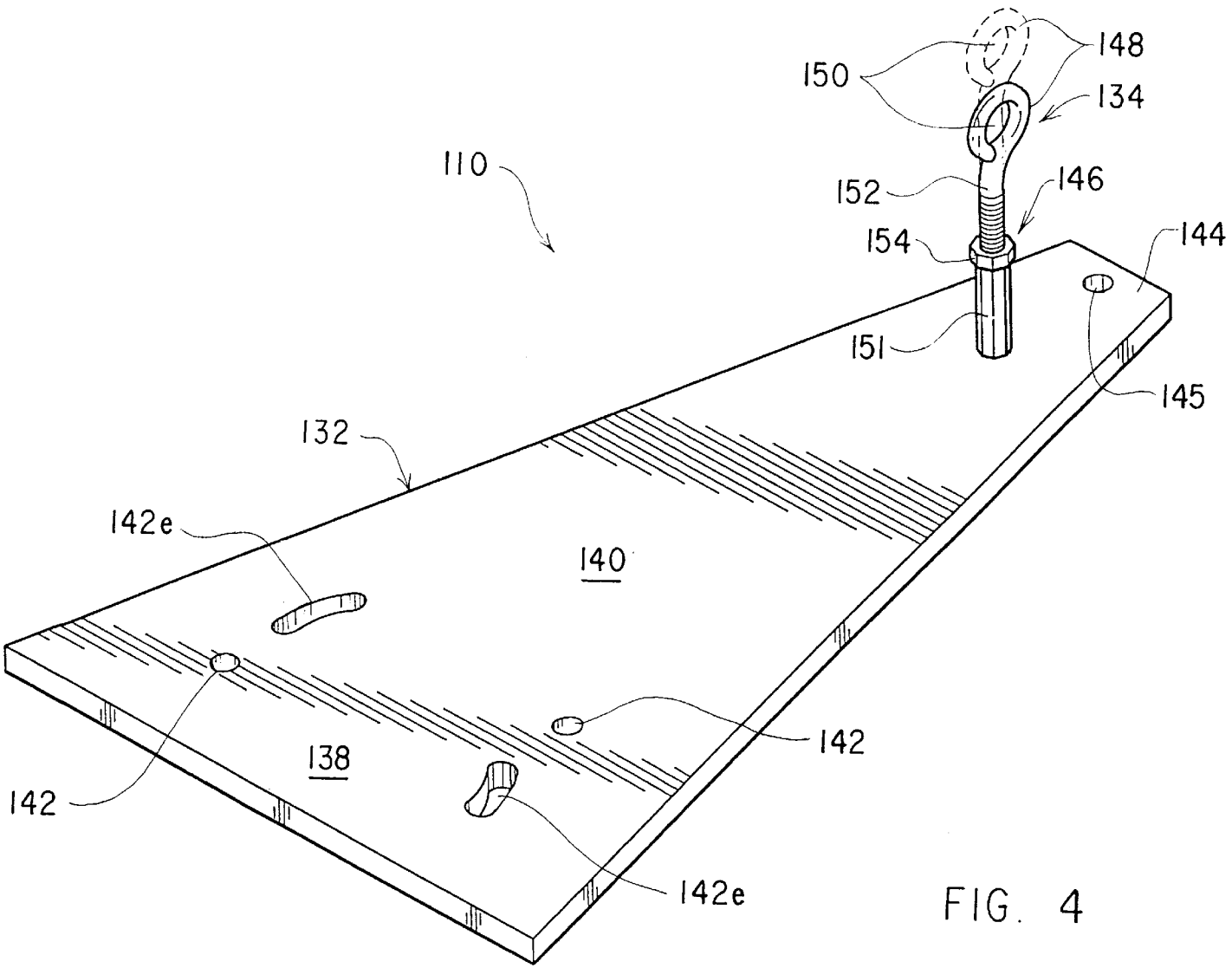
FIG. 4 is a perspective view of an alternate embodiment of the rear in-line bow sight of the present invention.

FIG. 4 is a perspective view of an alternate embodiment of the rear in-line bow sight assembly 110 according to the present invention. Similar to the embodiment depicted in FIG. 1 through FIG. 3, the rear sight assembly 110 of the embodiment depicted in FIG. 4 may cooperate with any number of a variety of commercially available front sight assemblies.

The alternate embodiment of the rear bow sight 110 comprises a support bracket 132 and a sight member 134. Elimination of the sight guard provides for a lighter-weight device. To further minimize the weight, it is preferable if the rear bow sight 110 is constructed from a light-weight material, such as aluminum.

The support bracket 132 includes a relatively wide mounting plate 138, which is used to mount the support bracket to a portion of the bow, and an integral elongated extension 140. To secure the support bracket 132 to the bow frame 14, the mounting plate 138 is provided with a plurality of openings 142 passing therethrough. The plurality of openings 142 are disposed to receive threaded securing screws, as previously discussed. The inclusion of additional arcuate elongated openings or slots 142*e* enables positionable attachment of the rear sight assembly 110 to the bow riser for adjustable clearance of the bow string. Once the support bracket 132 is secured to the bow frame by the support bracket mounting plate 138, the elongated extension 140 thereon projects rearwardly of the mounting plate 138. A terminal end 144 of the extension 140 lies intermediate the string and the bow frame so as to avoid any interference with the string.

The support bracket 132 of the present embodiment further possesses a plurality of sight member holes 145 disposed in axial alignment along the elongated extension 140, adjacent the terminal end 144. Each sight member hole 145 is sized for passage of the sight member 134 therethrough for secure connection of the same to the support bracket 132. The plurality of sight member holes 145 enable the archer to selectively adjust the position of the sight member 134 rearward relative to the bow. This better enables the archer to use the rear bow sight 110 in conjunction with various sized bows and still achieve an optimal compromise between the first goal of maximizing the distance between the sight pins of the front sight assembly and the sight member 134, and the competing second goal of providing adequate clearance of the bow string.

The sight member 134 includes an elongated neck 146 having a sight head 148 on the end thereof. The neck 146 is fixed at a substantially 90° angle to the extension 140 such that the sight head 148 is aligned perpendicularly to an archer's line of vision to the target. The sight head 148 has an aperture 150 passing centrally therethrough that allows an archer to adjust the inclination of the bow by viewing a given sight pin of the front sight assembly through the aperture, as previously discussed.

Since each archer holds the bow at a slightly different position when the bow is at full draw, an adjustable connection between the sight member and the support bracket is desirable. In the embodiment depicted in FIG. 4, the sight member 134 is adjustably mounted to the support bracket 132 for allowing an archer to set the sight member 134 to a position which is well suited and comfortable for his or her particular preference.

The adjustable connection may be obtained through various means, but should be sufficiently rigid and durable to withstand any normal abuse of the bow while hunting. Depicted in FIG. 4, the adjustable sight member 134 includes a coupling nut 151 secured to the support bracket 132 by a screw (not shown) and an eye bolt 152, screwed into the coupling nut 151. The eye bolt 152 and coupling nut 151 together form the sight head 148 and elongated neck 146. The eye hook 152 may, thereby be tightened or loosened from the coupling nut 151 to achieve the desired positioning of the aperture 150 which is formed by the eye hook 152. Once positioned, the eye hook 152 is secured in place by a lock nut 154. The length of the coupling nut makes it particularly useful for those situations in which the rear bow sight is used in conjunction with bows having off-set risers. For those bows which do not have off-set risers, the adjustable sight member 134 may more simply comprise an eye hook screwed directly through the support bracket (not shown). In this case, the positioned eye hook may be secured in place by a pair of lock nuts screwed to the eye bolt on opposite sides of the support bracket.

It is to be understood that the present invention is not limited to the sole embodiment described above, but encompasses any and all embodiments within the scope of the following claims.

We claim:

1. A rear sight assembly for use with an archery bow having a bow frame, an arrow-impelling string attached to the bow frame, a conventional front sight assembly, and preexisting fasteners securing the front sight assembly to the bow frame, the rear sight assembly comprising:

a support bracket having a mounting portion adapted for connection to the bow frame, and having an integral elongated extension, said mounting portion having at least one hole and at least one slot, each of said at least one hole and said at least one slot being adapted for the passage of a respective one of the preexisting fasteners of the bow for allowing said support bracket to be secured to the bow frame while permitting adjustments in the positioning of said support bracket relative to the bow frame, said integral elongated extension having a plurality of holes distributed along its length; and a sight member angularly depending from said integral elongated extension of said support bracket, said sight member being secured to said integral elongated extension using a selected one of said plurality of holes distributed along said integral elongated extension, said sight member being located at a position along said integral elongated extension relative to the bow frame, said plurality of holes distributed along said integral elongated extension enabling an archer to selectively adjust the position of said sight member relative to the bow frame along said integral elongated extension, said sight member having an aperture through which the front sight can be viewed when the rear sight assembly is secured to the bow frame and used to aim the archery bow at a target.

2. The rear bow sight assembly according to claim 1, wherein said sight member includes:

a threaded coupling nut removably secured to said integral elongated extension at said selected one of said plurality of holes distributed along said integral elongated extension;

an eye bolt threadably engaging said threaded coupling nut, said eye bolt having an eye which defines said aperture of said sight member, said threaded coupling nut being positioned intermediate said eye and said integral elongated extension of said support bracket; and a lock nut threadably engaging said eye bolt intermediate said eye of said eye bolt and said threaded coupling nut, said lock nut being tightened against said threaded coupling nut to selectively fix a distance between said eye of said eye bolt and said threaded coupling nut.

3. The rear bow sight assembly according to claim 1, wherein said at least one slot in said mounting portion of said support bracket is arcuate.

* * * * *